US007886755B2

(12) United States Patent
Tung

(10) Patent No.: US 7,886,755 B2
(45) Date of Patent: Feb. 15, 2011

(54) SIDE-SUPPORTING SUNSHADE

(76) Inventor: Benson Tung, No. 587, Chiengong Rd., Ditto, Kaohsiung (TW)

( * ) Notice: Subject to any disclaimer, the term of this patent is extended or adjusted under 35 U.S.C. 154(b) by 144 days.

(21) Appl. No.: 12/391,316

(22) Filed: Feb. 24, 2009

(65) Prior Publication Data

US 2010/0212705 A1 Aug. 26, 2010

(51) Int. Cl.
*A45B 11/00* (2006.01)
*A45B 25/02* (2006.01)

(52) U.S. Cl. ..... 135/21; 135/20.1; 135/20.3

(58) Field of Classification Search ..... 135/15.1, 135/20.1, 20.3, 21
See application file for complete search history.

(56) References Cited

U.S. PATENT DOCUMENTS 5,937,882 A * 8/1999 Harbaugh ..... 135/20.3
6,152,156 A 11/2000 Tung ..... 135/21
6,923,193 B2 * 8/2005 Chen ..... 135/20.1
7,334,590 B2 * 2/2008 Chang ..... 135/20.3
7,341,068 B2 3/2008 Liu ..... 135/20.3
7,398,790 B2 * 7/2008 Glatz ..... 135/20.1
2002/0121297 A1 * 9/2002 Li et al. ..... 135/20.1
2008/0236640 A1 * 10/2008 Huali et al. ..... 135/20.3
2010/0051074 A1 * 3/2010 Dan ..... 135/20.3

* cited by examiner

*Primary Examiner*—David Dunn
*Assistant Examiner*—Danielle Jackson
(74) *Attorney, Agent, or Firm*—Alan Kamrath; Kamrath & Associates PA

(57) ABSTRACT

A side-supporting sunshade includes a mast and an adjusting sleeve slideably mounted on the mast in a vertical direction. A lower end of a supporting arm is pivotably connected to the adjusting sleeve. A linking rod includes an end pivotably connected to an upper end of the mast. The other end of the linking rod is pivotably connected to an intermediate portion of the supporting arm. A canopy support frame is coupled to an upper end of the supporting arm and supports a canopy. A cable includes a first end fixed to an axle rotatably mounted in the adjusting sleeve and a second end fixed to the canopy support frame. The cable is movable in a winding direction to fold the canopy when the axle rotates in a direction. The cable is movable in a releasing direction to unfold the canopy when the axle rotates in a reverse direction.

11 Claims, 10 Drawing Sheets

SIDE-SUPPORTING SUNSHADE

BACKGROUND OF THE INVENTION

The present invention relates to a side-supporting sunshade and, more particularly, to a side-supporting sunshade having a canopy that can be folded or unfolded easily.

U.S. Pat. No. 6,152,156 discloses a sunshade including a supporting rod, a canopy supporting frame, and a canopy. An adjusting sleeve is slideably mounted around the supporting rod. A holding sleeve is pivotally connected to an upper end of the supporting rod. An arcuate tube is slideably extended through the holding sleeve. An elbow is mounted to an end of the arcuate tube, and a reel is mounted to the other end of the arcuate tube. A connecting rod is connected between the other end of the arcuate tube and the adjusting sleeve. An anchor is releasably engaged in an anchor room in the elbow to reliably retain the canopy support frame in a desired tilting angle relative to the supporting rod. However, formation of the arcuate tube by bending a metal tube is troublesome. Furthermore, the adjusting sleeve and the arcuate tube must be moved when adjustment of the tilting angle of the canopy support frame is desired.

U.S. Pat. No. 7,341,068 discloses a side-supporting umbrella including a collar slideably mounted on a mast that supports a canopy. An end of a supporting arm of the canopy is pivotally connected to the collar. A connecting brace has an end pivotally connected to an upper end of the mast. The other end of the connecting brace is pivotally connected to an intermediate portion of the supporting arm. The collar can be moved along the mast in the vertical direction to adjust a tilting angle of the canopy. A crank-driving winder is mounted to a lower end of the mast. An end of a line begins from the crank-driving winder and extends upward through an interior of the mast to the upper end of the mast. Then, the line passes over a first pulley mounted in the upper end of the mast into an interior of the connecting brace. Next, the line passes over a second pulley mounted in the supporting arm into an interior space in the supporting arm. Then, the line passes over a third pulley in an upper hub of the canopy and extends through the upper hub and finally connects to a lower hub of the canopy. The crank-driving winder can be operated to drive the line for opening or closing the canopy. After the canopy is closed, the collar can be moved to a lowest position to reduce the overall volume of the umbrella. However, operation of the crank-driving winder at the lower end of the mast is not convenient for users. Furthermore, the line has several bends between the mast and the lower hub, leading to difficulties in moving the line.

Thus, a need exists for a sunshade or umbrella that allows easy adjustment in a tilting angle of the canopy and that allows easy operation of folding/unfolding of the canopy.

BRIEF SUMMARY OF THE INVENTION

The present invention solves this need and other problems in the field of easy operation of sunshades by providing, in a preferred form, a side-supporting sunshade including a mast extending in a vertical direction. An adjusting sleeve is slideably mounted on the mast between an upper position and a lower position in the vertical direction. A supporting arm includes upper and lower ends and an intermediate portion between the upper and lower ends of the supporting arm. The lower end of the supporting arm is pivotably connected to the adjusting sleeve. A linking rod includes a first end pivotably connected to an upper end of the mast. The linking rod further includes a second end pivotably connected to the intermediate portion of the supporting arm. A canopy support frame is coupled to the upper end of the supporting arm and supports a canopy. A reel device is mounted to the adjusting sleeve and includes an axle rotatably mounted in the adjusting sleeve. The reel device further includes a handle coupled to the axle to rotate therewith. A cable includes a first end fixed to the axle and a second end fixed to the canopy support frame. The cable is movable in a winding direction to fold the canopy when the axle rotates in a direction. On the other hand, the cable is movable in a releasing direction to unfold the canopy when the axle rotates in a reverse direction.

In the most preferred form, the adjusting sleeve includes first and second ends spaced in a first direction perpendicular to the vertical direction. The adjusting sleeve further includes first and second lateral sides extending between the first and second ends of the adjusting sleeve. The first and second lateral sides are spaced in a second direction perpendicular to the first direction and the vertical direction. The first and second lateral sides and the first and second ends of the adjusting sleeve define a compartment slideably receiving the mast. The lower end of the supporting arm extends into the adjusting sleeve and is pivotably connected to the first end of the adjusting sleeve. The cable extends from the axle through an interior of the supporting arm to the canopy support frame. A pulley is rotatably mounted in the lower end of the supporting arm and guides the cable from the axle into the interior of the supporting arm.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
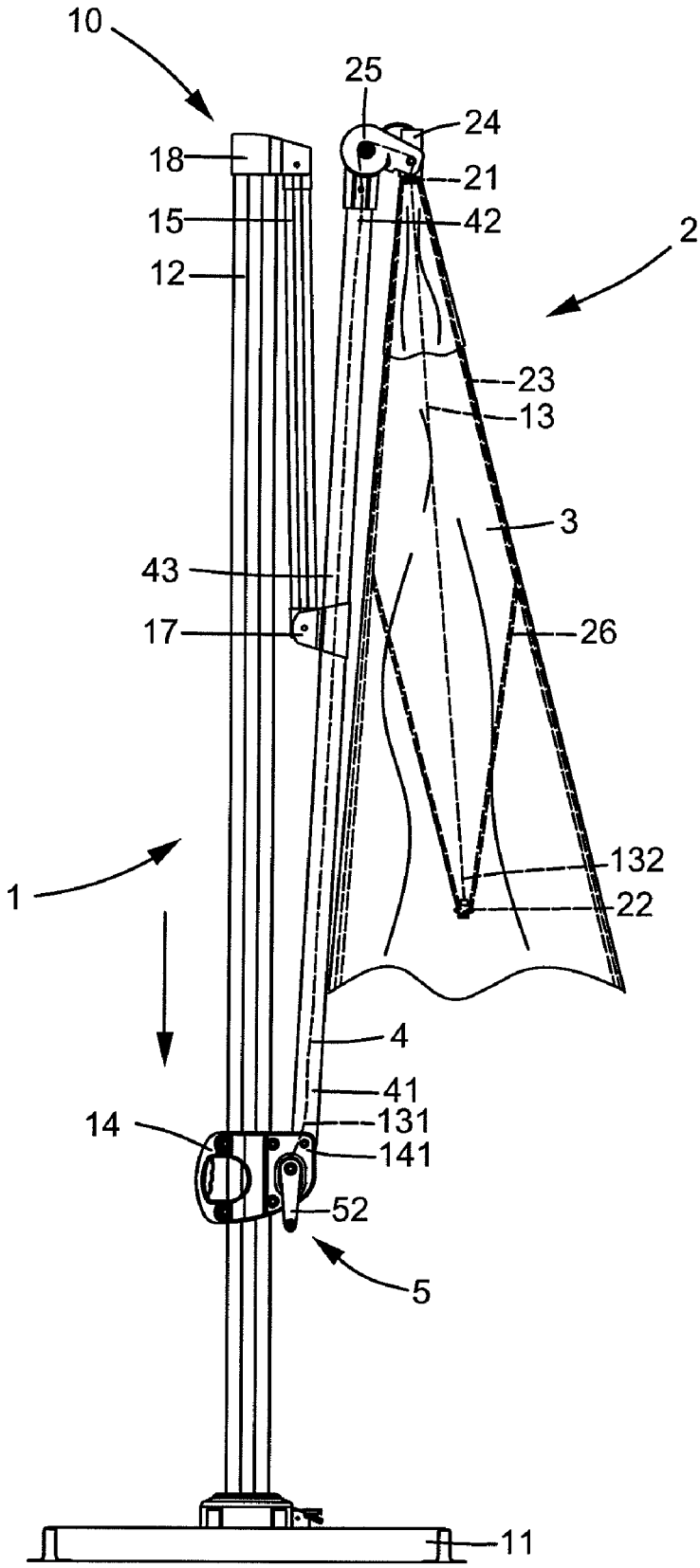
FIG. 1 shows a side view of a side-supporting sunshade according to the preferred teachings of the present invention with an adjusting sleeve in a lower position and with a canopy in a folded state.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "inner", "outer", "end", "axial", "vertical", "spacing", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A sunshade according to the preferred teachings of the present invention is shown in the drawings and generally designated 10. According to the preferred form shown, sunshade 10 includes a main frame 1 having a base 11 and a mast 12 extending upward from base 1 in a vertical direction. An adjusting sleeve 14 is slideably mounted on mast 12 in the vertical direction. A joint 18 is mounted on an upper end of mast 12. A supporting arm 4 includes upper and lower ends 41 and 42 and an intermediate portion 43 between upper and lower ends 41 and 42. A joint 17 is mounted to intermediate portion 43. A linking rod 15 has two ends pivotably connected to joints 17 and 18. Lower end 41 of supporting arm 4 is pivotably connected to adjusting sleeve 14.

According to the preferred form shown, sunshade 10 further includes a canopy support frame 2 having upper and lower hubs 21 and 22 spaced in the vertical direction. Canopy support frame 2 further includes a plurality of ribs 23 each having an end pivotably connected to upper hub 21. Canopy support frame 2 further includes a plurality of stretchers 26 each having a first end pivotably connected to lower hub 22 and a second end pivotably connected to an intermediate portion of one of ribs 23. A suspension member 24 is integrally formed with upper hub 21 and is pivotably connected to an elbow 25 fixed to upper end 42 of supporting arm 4. A canopy 3 is mounted to and supported by ribs 23. Canopy 3 is unfolded when lower hub 22 moves toward upper hub 21. On the other hand, canopy 3 is folded when lower hub 22 moves away from upper hub 21. Canopy support frame 2 can be of other forms as conventional including but not limited to a commercially available type.

According to the preferred form shown, mast 12 includes first and second sides spaced in a first direction perpendicular to the vertical axis. Each of first and second sides includes a groove 121 extending in the vertical direction and having a bottom wall 122. Bottom wall 122 of one of grooves 121 includes a plurality of positioning holes 123 spaced in the vertical direction.

According to the preferred form shown, adjusting sleeve 14 includes first and second ends 141 and 142 spaced in the first direction. Adjusting sleeve 14 further includes first and second lateral sides 148 extending between first and second ends 141 and 142 and spaced in a second direction perpendicular to the first direction and the vertical direction. A compartment 143 is defined by first and second ends 141 and 142 and first and second lateral sides 148. Adjusting sleeve 14 further includes an opening 140 extending in the second direction from first lateral side 148 through second lateral side 148 with a handgrip 149 formed at second end 142 of adjusting sleeve 14. Handgrip 149 includes an inner surface having a slot 150. Opening 140 is in communication with a portion of compartment 143 in an interior of handgrip 149 via slot 150. In the most preferred form shown, adjusting sleeve 14 includes two sleeve parts 144 assembled together. Note that mast 12 is slideably received in another portion of compartment 143 between opening 140 and first end 141 of adjusting sleeve 14 such that adjusting sleeve 14 can slide on mast 12 in the vertical direction with mast 12 intermediate first and second ends 141 and 142 of adjusting sleeve 14 and intermediate first and second lateral sides 148 of adjusting sleeve 14.

According to the preferred form shown, first end 141 of adjusting sleeve 14 includes a notch 146 in communication with compartment 143. Lower end 41 of supporting arm 4 extends through notch 146 into compartment 143. A pin 147 is extended through pin holes 151 in first and second lateral sides 148 and a pin hole 46 in lower end 41 of supporting arm 4 so that lower end 41 of supporting arm 4 is pivotable relative to adjusting sleeve 14. In the most preferred form shown, a pulley 45 is rotatably received in lower end 41 of supporting arm 4 and is extended through by pin 147. A jacket 44 is mounted around lower end 41 of supporting arm 4.

In the most preferred form shown, two upper rollers 19 are rotatably received in compartment 143 and slideable along bottom walls 122 of grooves 121. Two lower rollers 19 are rotatably received in compartment 143 and slideable along bottom walls 122 of grooves 121. Each lower roller 19 is spaced from one of upper rollers 19 in the vertical direction. Pins 192 are extended through pin holes 152 in first and second lateral sides 148 and axial holes 191 of upper and lower rollers 19. A screw 193 is engaged in a screw hole in each pin 192 to prevent disengagement of pin 192. A spacing between upper rollers 19 in the first direction is substantially equal to that between bottom walls 122 of grooves 121. Also, a spacing between lower rollers 19 in the first direction is substantially equal to that between bottom walls 122 of grooves 121. Namely, bottom walls 122 of mast 12 are received in a space defined between upper and lower rollers 19. Thus, upper and lower rollers 19 slide along bottom walls 122 when adjusting sleeve 14 moves in the vertical direction along mast 12. Movement of adjusting sleeve 14 in the vertical direction is, thus, easier. However, adjusting sleeve 14 can include only one roller 19 ore more than two rollers 19 in each groove 122 of mast 12. Note that upper and lower rollers 19 are intermediate opening 140 and first end 141 of adjusting sleeve 14 in the first direction.

According to the preferred form shown, sunshade further includes a positioning device 16 for positioning adjusting sleeve 14 at a desired height in the vertical direction. Specifically, positioning device 16 includes a lever 161, a peg 162, and a spring 163. In the most preferred form shown, lever 161 is received in the interior of handgrip 149 and includes a first end 164 pivotably connected by a pin 166 to second end 142 of adjusting sleeve 14. Lever 161 further includes a second end 165 pivotably connected to an end of peg 162. Second end 165 of lever 161 can pivot about a pivot axis defined by pin 166. An intermediate section of lever 161 between first and second ends 164 and 165 extends through slot 150 into opening 140 to allow manual operation. The other end of peg 162 is releasably engaged in one of positioning holes 123 of mast 12. Peg 162 is supported by a guide board 145 fixed in compartment 143 so that pivotal movement of lever 161 causes rectilinear movement of peg 162 in the first direction between an engaging position engaged with one of positioning holes 123 of mast 12 and a disengaged position disengaged from positioning holes 123. Spring 163 is mounted between lever 161 and an inner wall of adjusting sleeve 14 to bias peg 162 to the engaging position. Lever 161 can be pressed to overcome spring 163 and to disengage peg 162 from positioning holes 123 of mast 12, allowing movement of adjusting sleeve 14 in the vertical direction along mast 12. When lever 161 is released, peg 162 is engaged with one of positioning holes 123 to position adjusting sleeve 14 at a desired height.

According to the preferred form shown, sunshade 10 further includes a reel device 5 mounted to first end 141 of adjusting sleeve 14. Reel device 5 includes an axle 51 rotatably mounted in compartment 143. An end of axle 51 is located outside of adjusting sleeve 14. A screw 53 is engaged in a screw hole in an end face of the end of axle 51 to prevent disengagement of axle 51. Opening 140 is intermediate axle 51 and handgrip 149 in the first direction. A handle 52 is mounted to the end of axle 51 and can be manually operated to rotate axle 51. A cable 13 includes a first end 131 fixed to axle 51 and a second end 132. Cable 13 is guided by pulley 45 into an interior of supporting arm 4. Furthermore, cable 13 extends through the interior of supporting arm 4, elbow 25, suspension member 24, and upper hub 21. The second end 132 of cable 13 is fixed to lower hub 22. When axle 51 rotates in a direction, cable 13 moves in a winding direction to move lower hub 22 toward upper hub 21 so that canopy 3 is unfolded. On the other hand, when axle 51 rotates in a reverse direction, cable 13 moves in a releasing direction to move lower hub 22 away from upper hub 21 so that canopy 3 is folded. Thus, canopy 3 can be folded or unfolded by operating handle 52.

According to the preferred form shown, reel device 5 further includes a ratchet wheel 54 including a plurality of teeth 541 on an outer periphery thereof. Ratchet wheel 54 is mounted around and in friction contact with axle 51. Two washers 56 are mounted around axle 51 and on both sides of ratchet wheel 54. Reel device 5 further includes a catch 55 pivotably mounted to a seat 57 that is fixed in compartment 143. A spring 58 is mounted in compartment 143 and biases catch 55 to engage with one of teeth 541 of ratchet wheel 54. When axle 51 rotates in the direction for unfolding canopy 3, ratchet wheel 54 rotates together with axle 51 and pushes catch 55 away from teeth 541 so that catch 55 will not securely engage with teeth 541, allowing smooth rotation of axle 51. On the other hand, catch 55 is normally biased by spring 58 to engage with teeth 541 of ratchet wheel 54 to avoid rotation of axle 51 in the reverse direction for folding canopy 3. Thus, the user has to apply a larger rotational force to handle 12 to overcome the friction between ratchet wheel 54 and axle 51 so as to rotate axle 51 relative to ratchet wheel 54. After canopy 3 is unfolded, the momentum acting on cable 13 by the weight of canopy support frame 2 is smaller than the friction between ratchet wheel 51 and axle 51. Thus, undesired folding of canopy 3 is avoided unless the user applies a sufficient force to handle 52.

Figure 2:
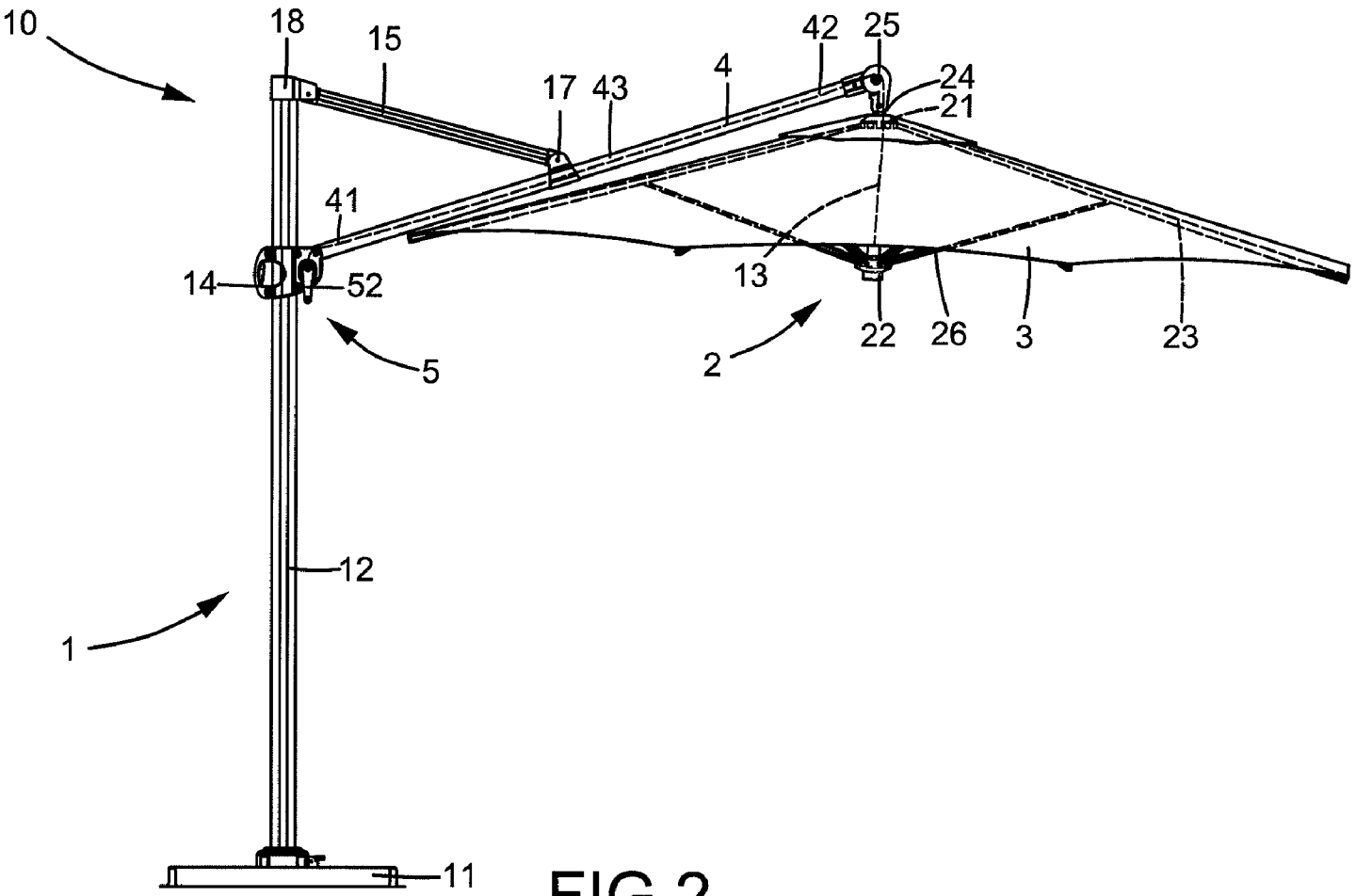
FIG. 2 shows a side view of the sunshade of FIG. 1 with the adjusting sleeve in an upper position and with the canopy in an unfolded state and in an upright position.
Figure 3:
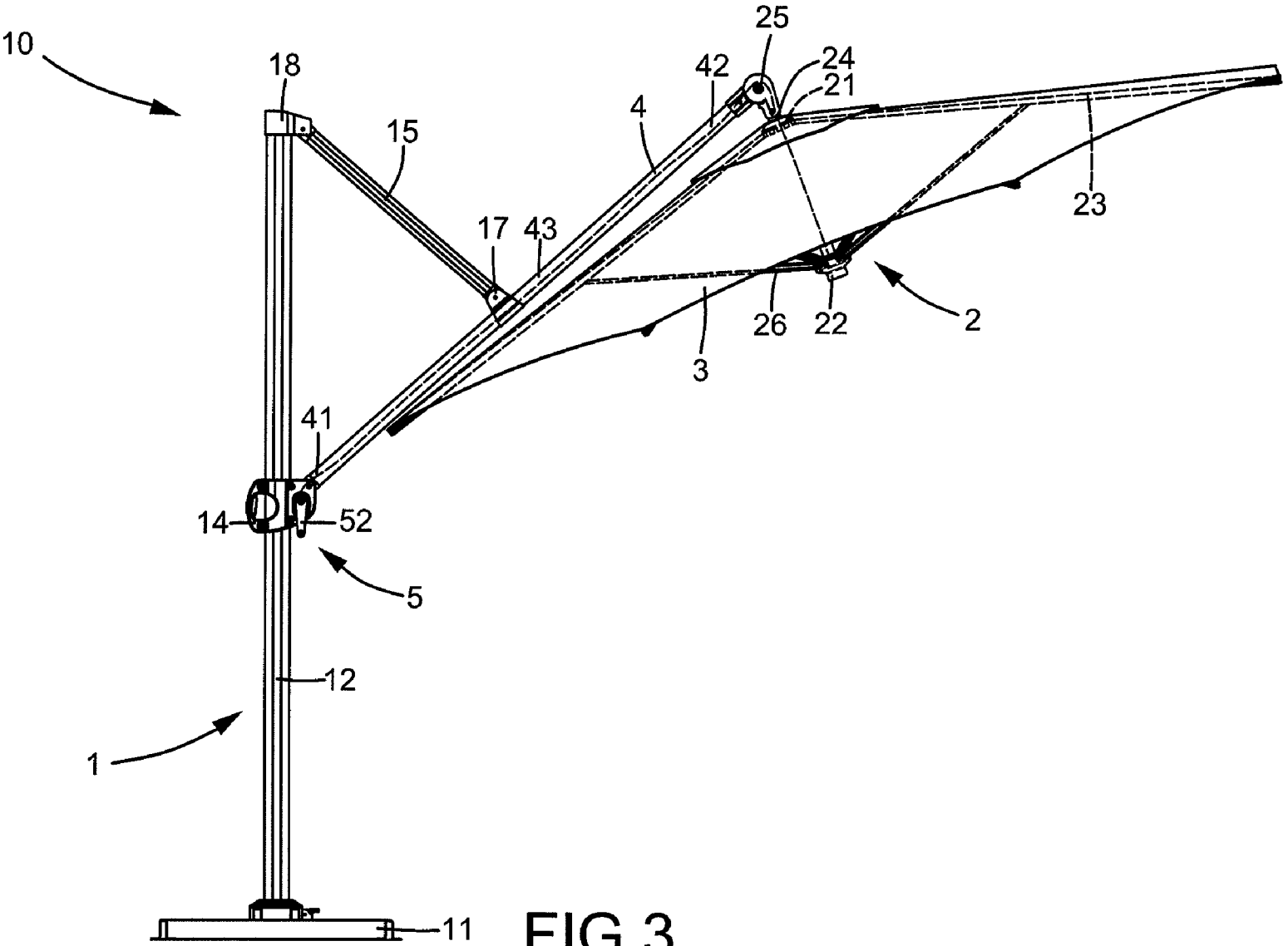
FIG. 3 shows a side view of the sunshade of FIG. 1 with the adjusting sleeve in a position intermediate the upper and lower positions and with the canopy in the unfolded state.
Figure 4:
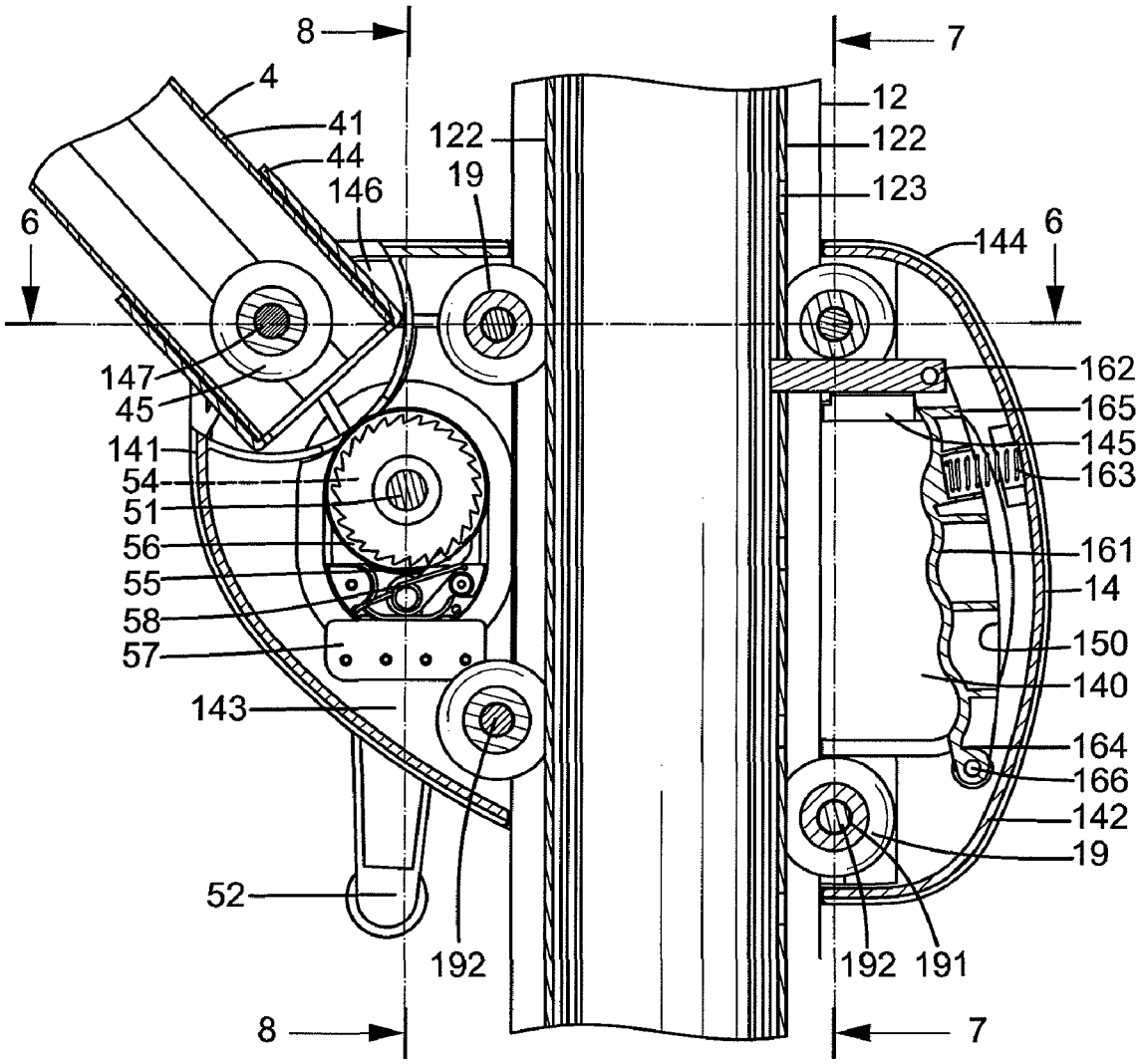
FIG. 4 shows a partial, cross sectional view of the sunshade of FIG. 1.
Figure 5:
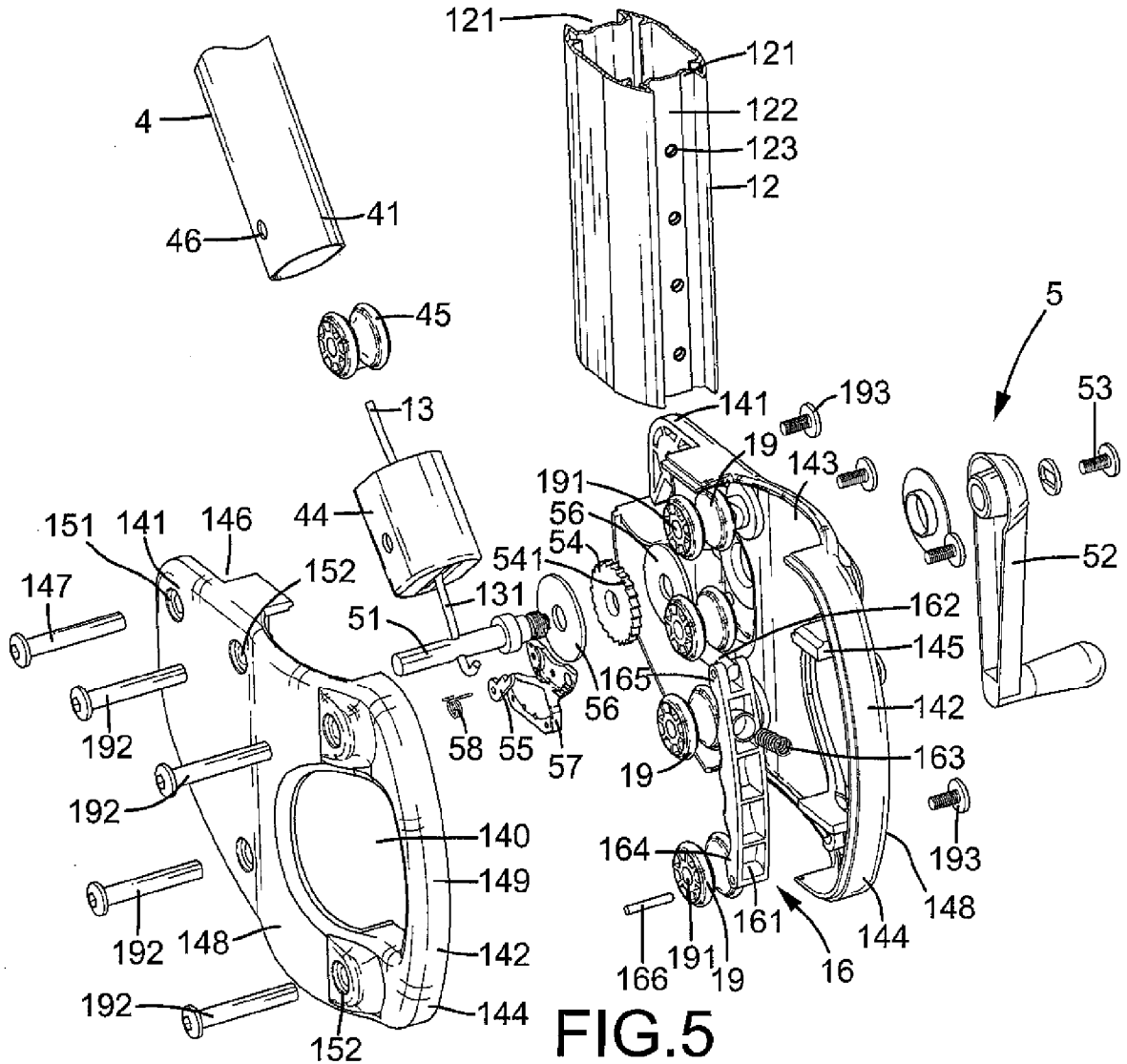
FIG. 5 shows an exploded, perspective view of components of the sunshade shown in FIG. 4.
Figure 6:
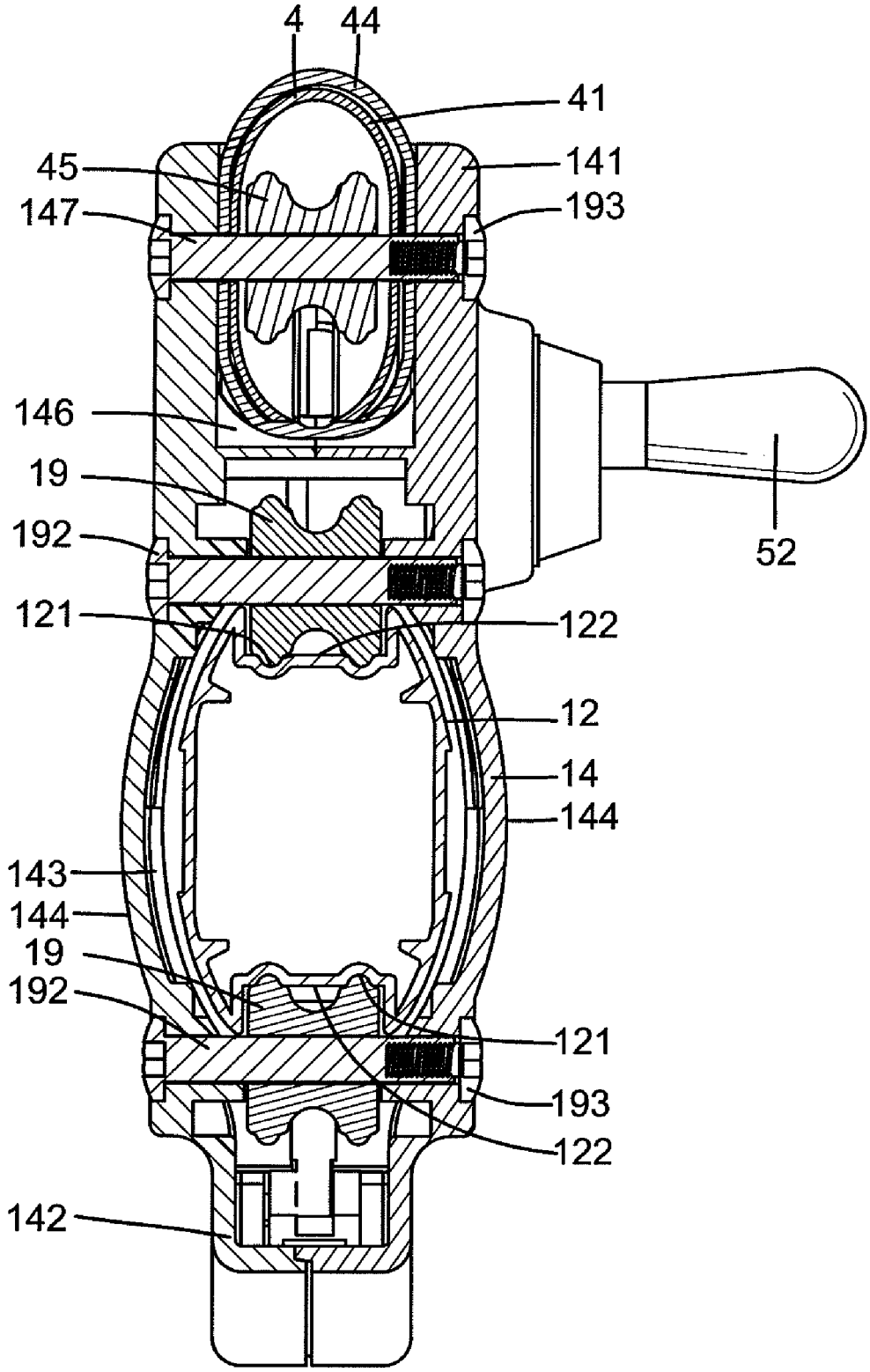
FIG. 6 shows a cross sectional view of the sunshade of FIG. 1 according to section line 6-6 of FIG. 4.
Figure 7:
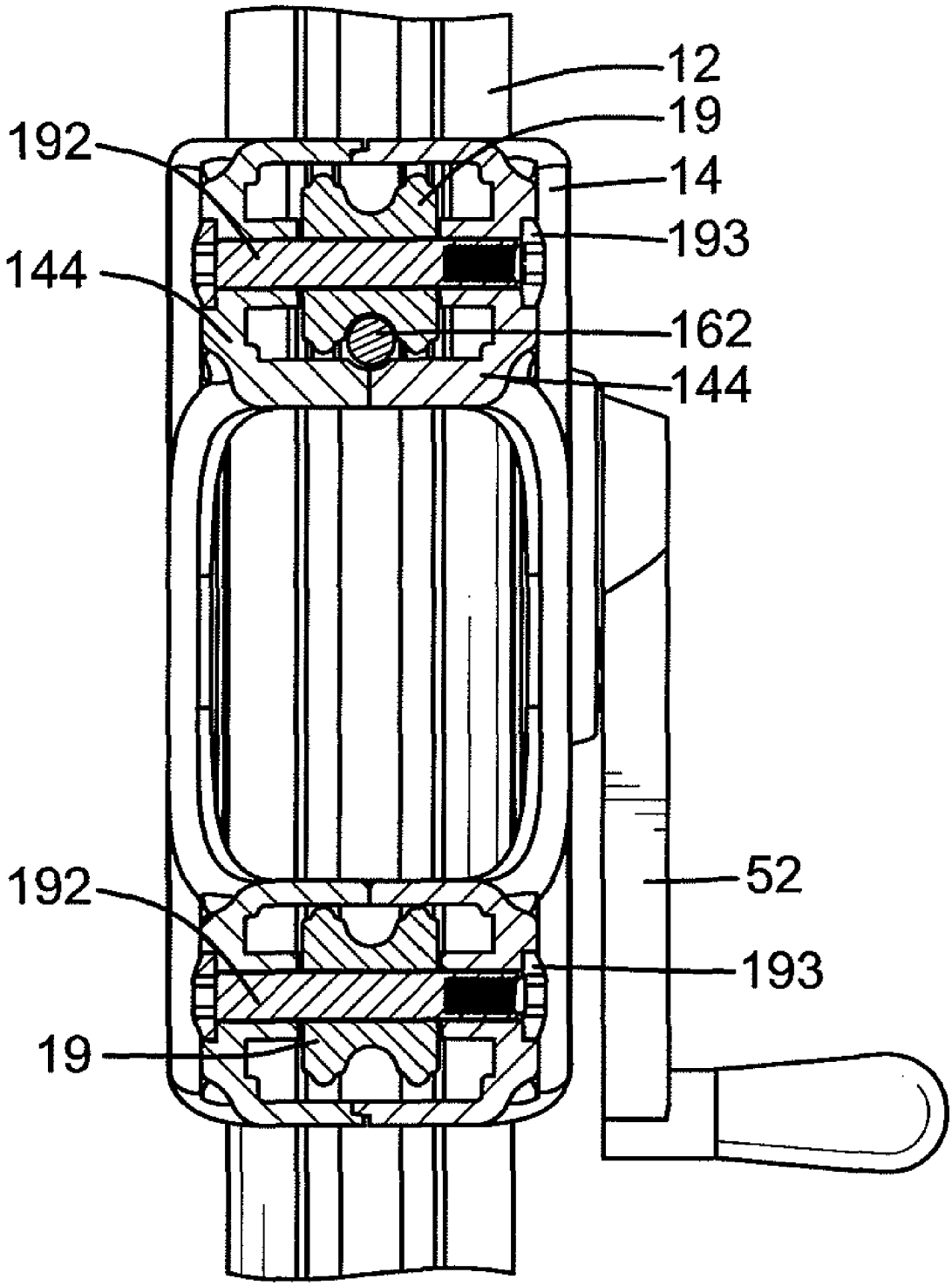
FIG. 7 shows a cross sectional view of the sunshade of FIG. 1 according to section line 7-7 of FIG. 4.
Figure 8:
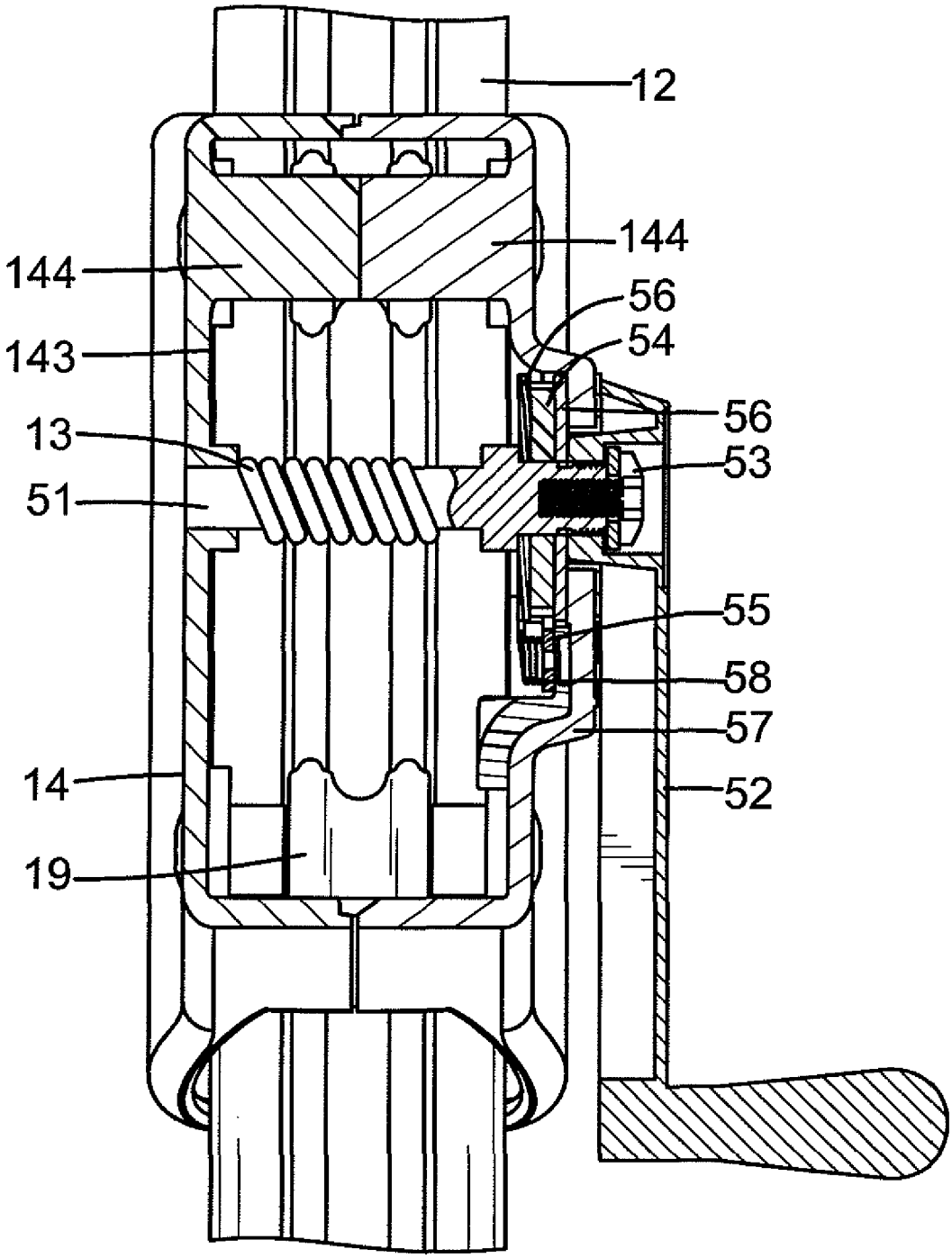
FIG. 8 shows a cross sectional view of the sunshade of FIG. 1 according to section line 8-8 of FIG. 4.
Figure 9:
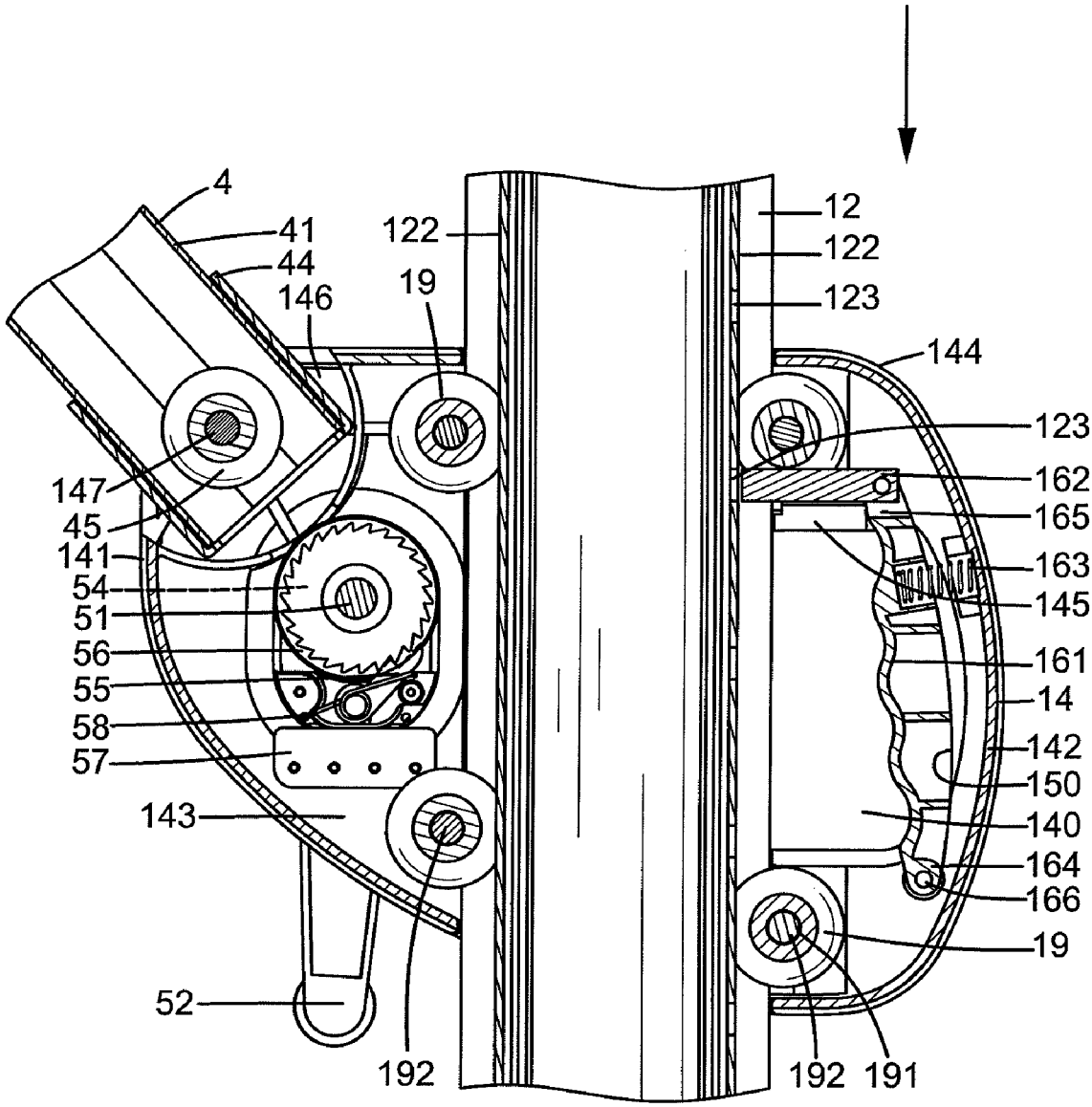
FIG. 9 is a cross sectional view similar to FIG. 4, with a lever pressed to allow movement of the adjusting sleeve in a vertical direction.
Figure 10:
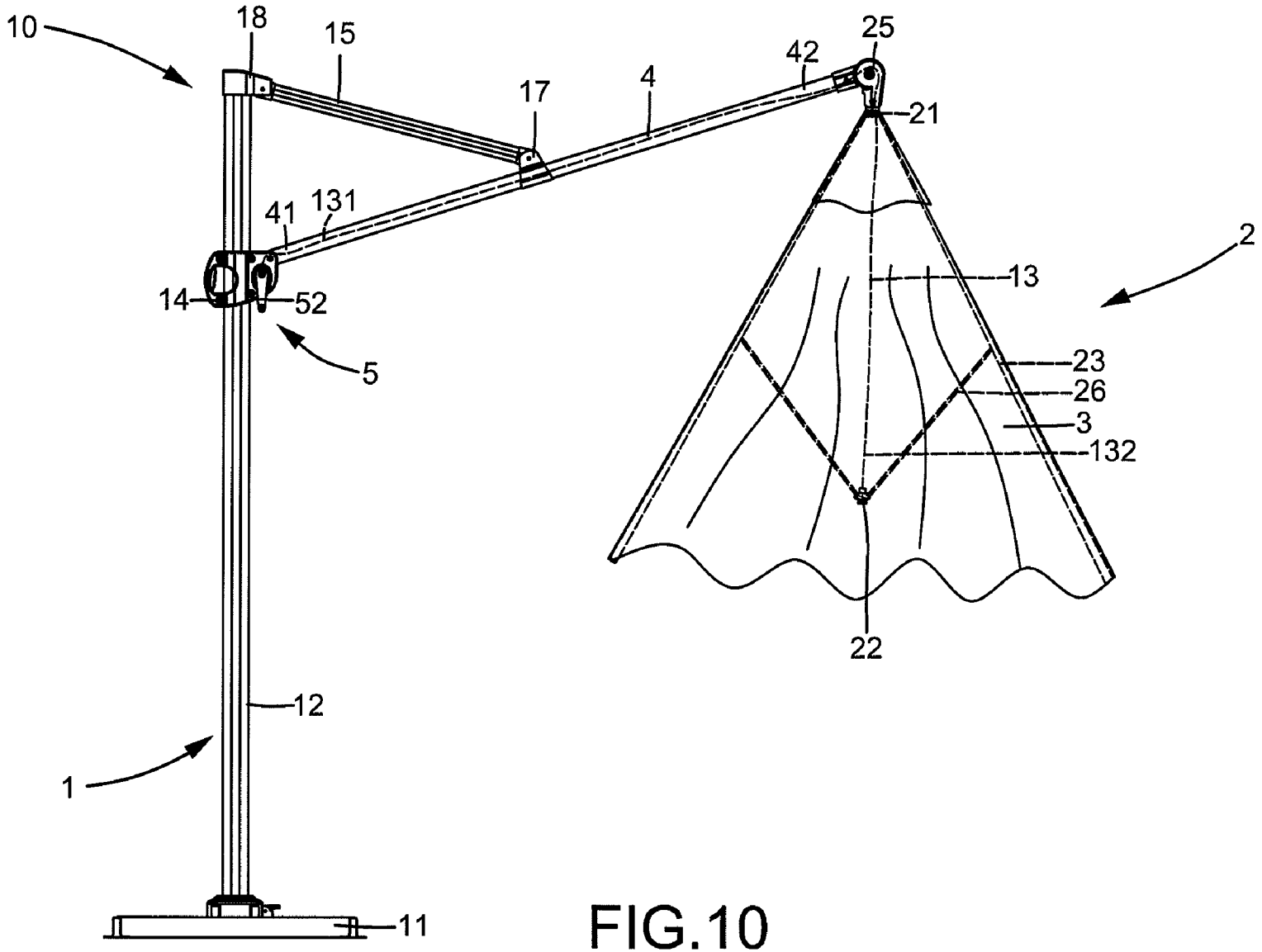
FIG. 10 shows a side view of the sunshade of FIG. 1 with the adjusting sleeve in the upper position and with the canopy partially folded.

In use, handle 52 can be operated to rotate axle 51 in a direction to release cable 13 so that canopy 3 is folded (FIGS. 1 and 10). When it is desired to lift canopy 3 to a desired height, the user presses lever 161 to disengage peg 162 from positioning holes 123 and then moves adjusting sleeve 14 to a desired height on mast 12. Adjusting sleeve 14 can be moved along mast 12 between a lower position and an upper position. Note that canopy 3 can be at a tiling angle with mast 12 by adjusting the position of adjusting sleeve 14 to be intermediate the upper and lower positions. When canopy 3 is in the desired position relative to mast 12, lever 161 is released to position adjusting sleeve 14 on mast 12. Handle 52 can be operated in a reverse direction to rotate axle 51 in a reverse direction to wind cable 13 around axle 51 so that canopy 3 is unfolded (FIG. 2). Note that reel device 5 is mounted on adjusting sleeve 14 that can be moved upward to a height suitable for easy operation of handle 52 by the user. Furthermore, cable 13 extending between axle 51 and lower hub 22 has few bends such that releasing and winding of cable 13 are smooth and easy. Rollers 19 in adjusting sleeve 14 allow smooth sliding of adjusting sleeve 14 on mast 12. Furthermore, handgrip 149 allows easy grip by a hand of the user while moving adjusting sleeve 14 on mast 12. Furthermore, lever 161 can be easily pressed by the hand holding handgrip 149. Further, the tiling angle of canopy 3 can be adjusted easily and smoothly.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A side-supporting sunshade comprising, in combination:

a mast extending in a vertical direction and including an upper end;

an adjusting sleeve slideably mounted on the mast between an upper position and a lower position in the vertical direction;

a supporting arm including upper and lower ends and an intermediate portion between the upper and lower ends of the supporting arm, with the lower end of the supporting arm pivotably connected to the adjusting sleeve;

a linking rod including a first end pivotably connected to the upper end of the mast, with the linking rod further including a second end pivotably connected to the intermediate portion of the supporting arm;

a canopy support frame coupled to the upper end of the supporting arm, with a canopy supported by the canopy support frame;

a reel device mounted to the adjusting sleeve and including an axle rotatably mounted in the adjusting sleeve, with the reel device further including a handle coupled to the axle to rotate therewith; and a cable including a first end fixed to the axle and a second end fixed to the canopy support frame, with the cable being movable in a winding direction to fold the canopy when the axle rotates in a direction, and with the cable being movable in a releasing direction to unfold the canopy when the axle rotates in a reverse direction, with the mast including first and second sides spaced in the first direction, with each of the first and second sides of the mast including a groove extending in the vertical direction and having a bottom wall, with the adjusting sleeve including first and second rollers rotatably received in the compartment and spaced in the first direction, with the first and second rollers sliding along the bottom walls of the grooves of the mast when the adjusting sleeve moves in the vertical direction.

2. The side-supporting sunshade as claimed in claim 1, with the adjusting sleeve including first and second ends spaced in a first direction perpendicular to the vertical direction, with the adjusting sleeve further including first and second lateral sides extending between the first and second ends of the adjusting sleeve, with the first and second lateral sides spaced in a second direction perpendicular to the first direction and the vertical direction, with the first and second lateral sides and the first and second ends of the adjusting sleeve defining a compartment slideably receiving the mast, and with the lower end of the supporting arm pivotably connected to the first end of the adjusting sleeve.

3. The side-supporting sunshade as claimed in claim 2, with the cable extending from the axle through an interior of the supporting arm to the canopy support frame, with the lower end of the supporting arm pivotably received in the compartment of the adjusting sleeve, and with a pulley rotatably mounted in the lower end of the supporting arm and guiding the cable from the axle into the interior of the supporting arm.

4. The side-supporting sunshade as claimed in claim 3, with the reel device further comprising: a ratchet wheel mounted around and in friction contact with the axle, with the ratchet wheel including a plurality of teeth on an outer periphery thereof; a catch pivotably connected to the adjusting sleeve; and a spring biasing the catch to engage with one of the plurality of teeth of the ratchet wheel, wherein when the axle rotates in the direction for unfolding the canopy, the ratchet wheel pushes the catch away from the plurality of teeth of the ratchet wheel so that the ratchet wheel and the axle rotate jointly, allowing smooth rotation of the axle, wherein the catch engages with the plurality of teeth of the ratchet wheel to stop rotation of the axle in the reverse direction for folding the canopy, the axle is rotatable when the axle is imparted with a rotational force larger than friction between the axle and the ratchet wheel.

5. The side-supporting sunshade as claimed in claim 2, with the bottom wall of the groove of one of the first and second sides of the mast including a plurality of positioning holes spaced in the vertical direction, with the sunshade further comprising, in combination: a lever including a first end pivotably connected to the adjusting sleeve, with the lever further including a second end; and a peg including a first end pivotably connected to the second end of the lever, with the peg further including a second end releasably engaged with one of the plurality of positioning holes of the mast.

6. The side-supporting sunshade as claimed in claim 5, with the first end of the lever being pivotably connected to the second end of the adjusting sleeve, with the sunshade further comprising, in combination: a spring mounted between the lever and the adjusting sleeve to bias the second end of the peg to engage with one of the plurality of positioning holes of the mast.

7. The side-supporting sunshade as claimed in claim 6, with the adjusting sleeve further including an opening extending from the first lateral side through the second lateral side with a handgrip formed at the second end of the adjusting sleeve and adapted to be gripped by a hand of a user holding the adjusting sleeve.

8. The side-supporting sunshade as claimed in claim 7, with the handgrip including an inner surface having a slot in communication with the compartment, with the lever including an intermediate section between the first and second ends of the lever, with the intermediate section of the lever extending into the opening via the slot under action of the spring.

9. The side-supporting sunshade as claimed in claim 8, with the first and second rollers intermediate the opening and the first end of the adjusting sleeve in the first direction, with the lever pivotably received in the handgrip, and with the opening intermediate the axle and the handgrip in the first direction.

10. The side-supporting sunshade as claimed in claim 9, with the reel device further comprising: a ratchet wheel mounted around and in friction contact with the axle, with the ratchet wheel including a plurality of teeth on an outer periphery thereof; a catch pivotably connected to the adjusting sleeve; and a spring biasing the catch to engage with one of the plurality of teeth of the ratchet wheel, wherein when the axle rotates in the direction for unfolding the canopy, the ratchet wheel pushes the catch away from the plurality of teeth of the ratchet wheel so that the ratchet wheel and the axle rotate jointly, allowing smooth rotation of the axle, wherein the catch engages with the plurality of teeth of the ratchet wheel to stop rotation of the axle in the reverse direction for folding the canopy, the axle is rotatable when the axle is imparted with a rotational force larger than friction between the axle and the ratchet wheel.

11. The side-supporting sunshade as claimed in claim 10, with the canopy being at a tilting angle with the mast when the adjusting sleeve is in a position intermediate the upper and lower positions.

* * * * *